US007891146B1

(12) United States Patent
Sherwin

(10) Patent No.: US 7,891,146 B1
(45) Date of Patent: Feb. 22, 2011

(54) CHANNEL TRACKS FOR ATTACHING STORM PANELS OVER OPENINGS ON BUILDINGS

(75) Inventor: John Sherwin, Cocoa Beach, FL (US)

(73) Assignee: University of Central Florida Research Foundation, Inc., Orlando, FL (US)

( * ) Notice: Subject to any disclaimer, the term of this patent is extended or adjusted under 35 U.S.C. 154(b) by 494 days.

(21) Appl. No.: 11/868,185

(22) Filed: Oct. 5, 2007

(51) Int. Cl.
*E06B 5/00* (2006.01)

(52) U.S. Cl. ..... 52/202; 52/203; 52/762; 52/770; 52/772; 52/204.71

(58) Field of Classification Search ..... 52/202, 52/203, 762, 764, 770, 772, 780, 204.71; 49/50, 57, 463
See application file for complete search history.

(56) References Cited

U.S. PATENT DOCUMENTS

| | | | | | |
|---|---|---|---|---|---|
| 2,258,574 | A | | 10/1941 | Leary | |
| 2,309,453 | A | | 1/1943 | Hasenburger et al. | |
| 2,379,179 | A | | 6/1945 | Petersen | |
| 2,567,554 | A | | 9/1951 | Davey | |
| 2,790,559 | A | | 4/1957 | Stephenson | |
| 2,796,624 | A | | 6/1957 | Speer | |
| 2,934,180 | A | | 4/1960 | Hammitt et al. | |
| 3,675,383 | A | | 7/1972 | Paoletti | |
| 3,712,015 | A | | 1/1973 | Nelson | |
| 3,738,083 | A | | 6/1973 | Shimano | |
| 4,028,856 | A | | 6/1977 | Dalbec | |
| 4,089,143 | A | * | 5/1978 | La Pietra | 52/202 |
| 4,121,379 | A | * | 10/1978 | Everson | 52/202 |
| 4,685,261 | A | * | 8/1987 | Seaquist | 52/202 |
| 4,703,603 | A | | 11/1987 | Hills | |
| 4,819,390 | A | | 4/1989 | Capper et al. | |
| 5,076,035 | A | | 12/1991 | Wright | |
| 5,560,170 | A | | 10/1996 | Ganser et al. | |
| 5,620,037 | A | | 4/1997 | Apostolo | |
| 5,740,639 | A | | 4/1998 | Covington | |
| 5,761,860 | A | | 6/1998 | Koike et al. | |
| 5,768,833 | A | | 6/1998 | Golen | |
| 5,966,893 | A | | 10/1999 | Quillin | |
| 6,047,500 | A | | 4/2000 | Caplette | |
| 6,108,990 | A | | 8/2000 | Klamer | |
| 6,269,597 | B1 | * | 8/2001 | Haas | 52/203 |
| 6,807,781 | B2 | | 10/2004 | Trout | |

(Continued)

*Primary Examiner*—Brian E Glessner
*Assistant Examiner*—Matthew J Smith
(74) *Attorney, Agent, or Firm*—Brian S. Steinberger; Law Offices of Brian S. Steinberger, P.A.

(57) ABSTRACT

Devices, apparatus, systems and methods of attaching storm panels over window and door openings with end fastenable H tracks. Each of the tracks can have H cross-sectional shapes with elongated opposite facing C shaped channels back to back along the elongated tracks. At the upper and lower ends of the tracks can be outwardly protruding tabs having through-holes for allowing the tracks to mounted into frame edges about the window and door openings. Rectangular shutter panels such as plywood, metal and plastic sheeting can have side edges that slidably fit into the C channel openings of the H tracks so that the only fasteners to attach the panels over the building openings are through the track tabs. Stop flanges can prevent the panels from sliding out of the channels. The track, brackets can be mounted horizontal and parallel to one another as well as be mounted vertically and parallel to one another.

14 Claims, 7 Drawing Sheets

U.S. PATENT DOCUMENTS 6,820,381 B1 11/2004 Ballough
7,150,126 B2 12/2006 Rivera
7,654,044 B2 * 2/2010 Borland ..... 52/202
2006/0236622 A1 10/2006 Allen et al.
2007/0084138 A1 4/2007 Cassista et al.
2007/0107328 A1 * 5/2007 Munch ..... 52/202

* cited by examiner

CHANNEL TRACKS FOR ATTACHING STORM PANELS OVER OPENINGS ON BUILDINGS

This invention relates to storm panels, in particular to devices, apparatus, systems and methods of attaching storm panels over window and door openings with end fastenable H track brackets.

BACKGROUND AND PRIOR ART

Shutters have become popular for buildings such as those in Florida due to the many wind and rainstorms caused by hurricanes, and other dangerous storms having strong winds of over 10 to 20 miles per hour. New building codes now require most new construction in especially coastal parts of states such as Florida to have removable shutters where these structures are often being outfitted with elaborate and wind tested shutters such as those found in roll down shutters, and accordion shutter panels that attach to pre-fixed C channel brackets. Such permanently installed visible channels are aesthetically undesirable since they detract from the appearance of the house and are not easy to hide. Additionally, most older residential homes still require the user to have rush to install storm panels such as plywood, metal and plastic sheeting often with nail fasteners which although being very popular has many problems.

Having to install a plywood panel of either 4×4 up to 4×8 foot usually requires the installer have to rush to pound in many nails around at least the top and bottom of the panels into the framed openings about the windows and/or doors. With an impending storm, the installers have little and precious time to waste. Pounding nails into the paneling every few inches coupled with the difficulty of having to physically lift and handle a large and heavy sheet is quite difficult to do especially if the structure has several or more window and door openings. Furthermore, the pounding of many nails inches apart from one another causes' extensive damage to the underlying window and door frames. Furthermore, the plywood cannot be used more than one season since the nails rip up the perimeter edges of the plywood, impact the strength integrity of the plywood, result in little reuse for the plywood since the ripped up plywood edges are not easily stackable.

Additionally, many window and door openings require having to attach two or more panels to one another to properly cover the opening. Nailing two 4×4 foot panels together, or two 4×6 foot panels together or two 4×8 foot panels together for large openings has additional problems since the adjoining edges need to be flush side edge to side edge to one another. If the adjoining sheet panels such as plywood panels are not tightly, locked together, the excessive wind can easily cause one of the exposed edges between the panels to peel and rip from the window/door opening which can result in damage to the inside of the building due to water and wind intrusion. Overlaying a strip of wood over the seams is often not practical since the seams are often over glass so that nailing a strip of material over the seam between plywood panel edges can result in damaging the underlying glass.

Thus, the need exists for solutions to the above problems with the prior art.

SUMMARY OF THE INVENTION

A primary objective of the present invention is to provide devices, apparatus, systems and methods of attaching storm panels over window and door openings with end fastenable H tracks that substantially reduces the amount of fasteners needed to protect window and door openings with shutter type panels.

A secondary objective of the present invention is to provide devices, apparatus, systems and methods of attaching storm panels over window and door openings with end fastenable H tracks that substantially speeds up the time for an installer to mount shutter type panels over window and door openings.

A third objective of the present invention is to provide devices, apparatus, systems and methods of attaching storm panels over window and door openings with end fastenable H tracks that substantially reduces the amount of damage to underlying structures that occurs by mounting shutter type panels over window and door openings.

A fourth objective of the present invention is to provide devices, apparatus, systems and methods of attaching storm panels over window and door openings with end fastenable H tracks that substantially reduces the amount of needed to remove shutter type panels from window and door openings.

A fifth objective of the present invention is to provide devices, apparatus, systems and methods of attaching storm panels over window and door openings with end fastenable H tracks that prevents end to end mounted shutter type panels from separating from one another during storms such as wind, rain and hurricane storms.

A sixth objective of the present invention is to provide devices, apparatus, systems and methods of attaching storm panels end to end together without any additional fasteners diver a window and door opening.

A seventh objective of the present invention is to provide devices, apparatus, systems and methods of attaching storm panels end to end together over window and door openings that substantially reduces the risk of edges of the panels peeling off during wind, rain and hurricane storms.

An eight objective of the present invention is to provide devices, apparatus, systems and methods of attaching storm panels end to end together over window and door openings that is able to use different panels such as but not limited to plywood, plastic, and metal with one universal mounting bracket used in two or three locations.

A preferred embodiment of the invention is a storm panel mounting system for mounting storm panels over window and door openings, that can include an exterior opening to a building the exterior rectangular opening having frame edges, the exterior rectangular opening being selected from at least one of a door opening with a door covering the color opening, and a window opening with a window covering the window opening, a rectangular shutter panel being sized to substantially cover a portion of the exterior rectangular opening, the rectangular shutter panel having an elongated left side edge and an elongated right side edge.

The system can include a first elongated mounting track having an H cross-sectional shape between opposing left and right ends, the first elongated mounting track having a upper facing U shaped channel along one elongated side and an opposite lower facing U shaped channel along an another elongated side that is directly opposite to the one elongated side, each of the opposing left and right ends of the first elongated mounting track having outwardly protruding tabs, with each of the tabs having a through-hole, a first left fastener for fastening the left tab of the first elongated mounting track into a portion of the frame edge above a left corner of the rectangular building opening, a first right fastener for fastening the right tab of the first elongated mounting track into a portion of the frame edge above a right corner of the rectangular building opening.

The system can include a second elongated mounting track having an H cross-sectional shape between opposing left and right ends, the second elongated mounting track having a upper facing U shaped channel along one elongated side and an opposite lower facing U shaped channel along an another elongated side that is directly opposite to the one elongated side, each of the opposing left and right ends of the second elongated mounting track having outwardly protruding left and right tabs, with the left tab and the right tab having a through-hole, a second left fastener for fastening the left tab of the second elongated mounting track into a portion of the frame, edge below the left corner of the rectangular building opening, a second right fastener for fastening the right tab of the second elongated mounting track, into a portion of the frame edge below the right corner of the rectangular building opening.

The rectangular shutter panel can be held in place over the portion of the exterior building opening by the first elongated mounting track and the second elongated mounting track, wherein the elongated top side edge of the rectangular shutter panel fits into the lower facing U shaped channel of the first elongated mounting track, and the elongated bottom side edge of the rectangular shutter panel fits into the upper facing U shaped channel of the second elongated mounting track.

The storm panel mounting system can also include a second rectangular shutter panel being sized to substantially cover another portion of the exterior rectangular opening, the second rectangular shutter panel having an elongated upper side edge and an elongated lower side edge, a third elongated mounting track having an H cross-sectional shape between opposing left and right ends, the third elongated mounting track having a upper facing U shaped channel along one elongated side and an opposite lower facing U shaped channel along an another elongated side that is directly opposite to the one elongated side, each of the opposing left and right ends of the second elongated mounting track having outwardly protruding tabs, with the left tab and the right tab having a through-hole.

The storm panel mounting system can include a third left fastener for fastening the left tab of the third elongated mounting track into a portion of the frame edge below a left corner of the rectangular building opening, and a third right fastener for fastening the right tab of the third elongated mounting track into a portion of the frame edge below a right corner of the rectangular building opening, so that the second rectangular shutter panel is held in place over the exterior building opening by the second elongated mounting track and the third elongated mounting track, wherein the elongated upper side edge of the second rectangular shutter panel fits into the lower facing U shaped channel of the second elongated mounting track, and the elongated lower side edge of the second rectangular shutter panel fits into the upper facing U shaped channel of the third elongated mounting track.

The fasteners can be screws. The fasteners can be bolts. The fasteners can also be nails. The storm panels used with the invention can be plywood sheets of varying sizes. The storm panels can be plastic sheets. The storm panels can be metal panels. The storm panels can be corrugated plastic and/or metal panels.

The invention can be manufactured and sold as single mounting tracks where each track has an elongated member having an H cross-sectional shape between opposing top and bottom ends, a left facing U shaped channel along one elongated side the elongated member, a right facing U shaped channel opposite the left facing U shaped channel, the right facing U shaped channel along an another elongated side that is directly opposite to the one elongated side, and outwardly protruding tabs extending from each of the opposing top and bottom ends of the elongated member and each of the top tab and the bottom tabs each having a through-hole for receiving a respective fastener therethrough.

The top tab and the bottom tab can each be single flat plates, each with only a single through-hole through each plate.

The invention can include a method of mounting shutter panels to window and door openings, that includes the steps of providing a rectangular shutter panel being sized to substantially cover a portion of the exterior rectangular opening, the rectangular shutter panel having an elongated upper side edge and an elongated lower side edge, and providing a first elongated mounting track having an H cross-sectional shape between opposing left and right ends, the first elongated mounting track having a upper facing U shaped channel along one elongated side and an opposite lower facing U shaped channel along an another elongated side that is directly opposite to the one elongated side, each of the opposing left and right ends of the first elongated mounting track having outwardly protruding tabs, with the left tab and the right tab having a through-hole.

The method can also include the steps of fastening a first left fastener to the left tab of the first elongated mounting track into a portion of the frame edge above a left corner of the rectangular building opening, fastening a first right fastener to the right tab of the first elongated mounting track into a portion of the frame edge above a right corner of the rectangular building opening.

The method can include the steps of providing a second elongated mounting track having an H cross-sectional shape between left and right ends, the second elongated mounting track having a upper, facing U shaped channel along one elongated side and an opposite lower facing U shaped channel along an another elongated side that is directly opposite to the one elongated side, each of the opposing left and right ends of the second elongated mounting track having outwardly protruding tabs, with the left and right tabs each having a through-hole.

The method can also include the steps of fastening a second left fastener to the left tab of the second elongated mounting track into a portion of the frame edge below the left corner of the rectangular building opening, fastening a second right fastener to the right tab of the second elongated mounting track into a portion of the frame edge below the right corner of the rectangular building opening, and mounting the rectangular shutter panel over the portion of the exterior building opening by the first elongated mounting track and the second elongated mounting track.

The step of mounting the rectangular shutter panel can include the steps of slidably inserting the elongated upper side edge of the rectangular shutter panel to fit into the lower facing U shaped channel of the first elongated mounting track, and slidably inserting the elongated lower side edge of the rectangular shutter panel to fit into the upper facing U shaped channel of the second elongated mounting track.

The method can also include the steps of providing a second rectangular shutter panel being sized to substantially cover another portion of the exterior rectangular opening, the second rectangular shutter panel having an elongated upper side edge and an elongated lower side edge, and providing a third elongated mounting track having an H cross-sectional shape between opposing left and right ends, the third elongated mounting track having an upper facing U shaped channel along one elongated side and an opposite lower facing U shaped channel along an another elongated side that is directly opposite to the one elongated side, each of the opposing left and right ends of the second elongated mounting track having outwardly protruding tabs, with the left and right tabs each having a through-hole.

The method can also include the steps of fastening a third left fastener to the left tab of the third elongated mounting track into a portion of the frame edge below a left corner of the rectangular building opening, fastening a third right fastener to the right tab of the third elongated mounting track into a portion of the frame edge below a right corner of the rectangular building opening, and mounting the second rectangular shutter panel in place over the exterior building opening by the second elongated mounting track and the third elongated mounting track by slidably inserting the elongated upper side edge of the second rectangular shutter panel to fit into the lower facing U shaped channel of the second elongated mounting track, and by slidably inserting the elongated lower side edge of the second rectangular shutter panel to fit into the upper facing U shaped channel of the third elongated mounting track.

The system, individual track brackets and method can also include L shaped stop flanges that can be easily attached to the tab ends of the brackets so that the shutter panels cannot slide sideways out from the channels of the brackets.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also; the terminology used herein is for the purpose of description and not of limitation.

A listing of components will now be described.

| | |
|---|---|
| 1. | H track bracket with tab ends |
| 10. | rear base member |
| 15. | Upper C-shape channel |
| 20 | front wall member |
| 25. | Lower C-shape channel |
| 30 | elongated cross member attaches rear base member to front wall member |
| 40. | left mounting tab. |
| 45. | through-hole of left mounting tab. |
| 50. | right mounting tab |
| 55. | through-hole of right mounting tab. |
| 60. | left stop flange |
| 62 | base of left flange |
| 65. | through-hole of left flange |
| 68. | bent stop edge |
| 70. | right stop flange |
| 72. | base of right flange |
| 75. | through-hole of right flange |
| 78. | bent stop edge. |
| 80. | fastener |
| 82. | bolt fastener |
| 84. | screw fastener |
| 86. | nail fastener |
| 92. | upper rectangular panel |
| 94. | lower rectangular panel |
| 100. | building |
| 110. | window opening |
| 200 | track bracket with gaskets |
| 210 | front wall |
| 215 | elongated T-shaped groove |
| 217 | elongated T-shaped caroove |
| 220 | rear base |
| 230 | mid cross member |
| 240 | tab |
| 245 | tab through-hole |

Figure 1A:
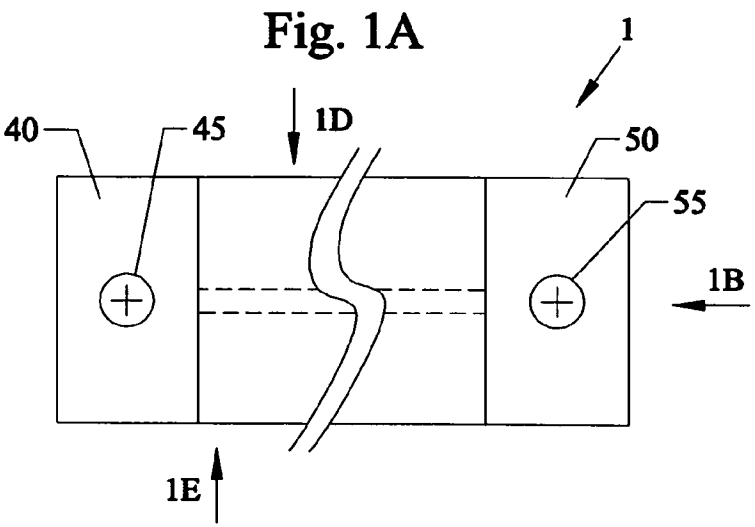
FIG. 1A is a front view of a first embodiment of the novel elongated track bracket.
Figure 1B:
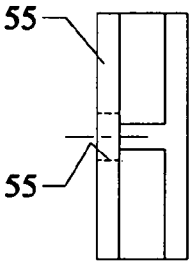
FIG. 1B is a side view elongated track bracket of FIG. 1A along arrow 1B.
Figure 2B:
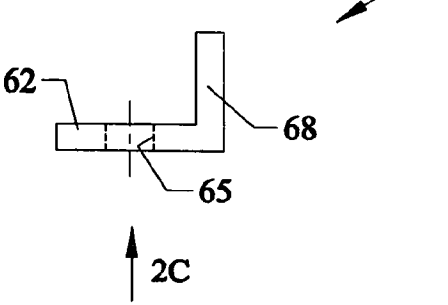
FIG. 2B is a side view of the stop flange of FIG. 2A along arrow 2B.
Figure 2A:
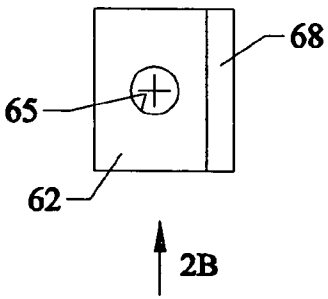
FIG. 2A is a top view of a stop flange used with the elongated track bracket of FIG. 1A.
Figure 2C:
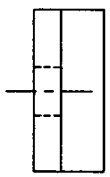
FIG. 2C is another side view of the stop flange of FIG. 2B along arrow 2C.
Figure 1D:
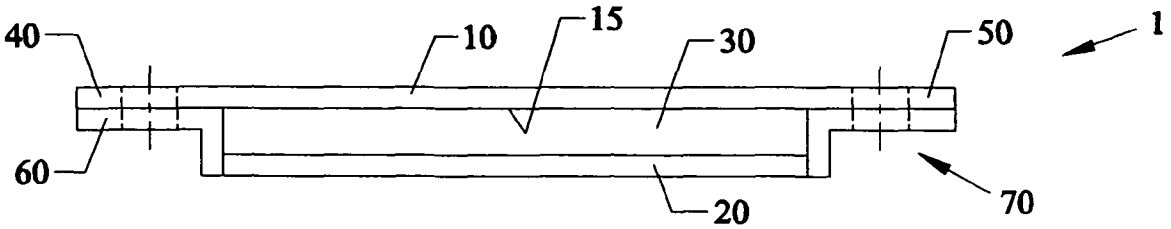
FIG. 1D is a top view of the elongated track bracket of FIG. 1A along arrow 1D with stop flanges.
Figure 1C:
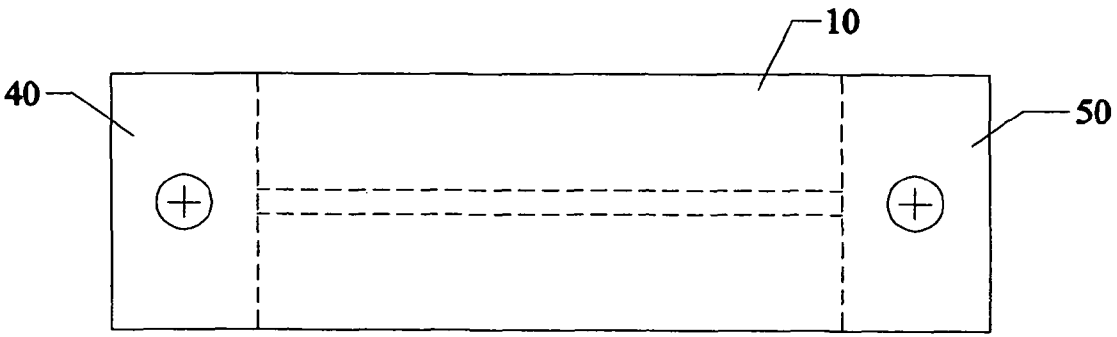
FIG. 1C is a back view of the elongated track bracket of FIG. 1A.
Figure 1E:
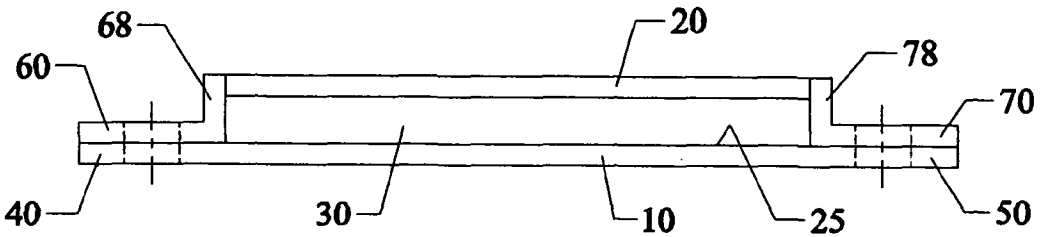
FIG. 1E is a bottom view of the elongated track bracket of FIG. 1A along arrow 1E.

FIG. 1A is a front view of a first embodiment of the novel elongated track bracket that can have an H cross-sectional shape between tab ends 40 and 50. FIG. 1B is a side view elongated track bracket 1 of FIG. 1A along arrow 13. FIG. 1C is a back view of the elongated track bracket 1 of FIG. 1A. FIG. 1D is a top view of the elongated track bracket 1 of FIG. 1A along arrow 1D with stop flanges 60, 70. FIG. 1E is a bottom view of the elongated track bracket 1 of FIG. 1A along arrow 1E. FIG. 2A is a top view of a stop flange 60 used with the elongated track bracket 1 of FIG. 1A. FIG. 2B is a side view of the stop flange 60 of FIG. 2A along arrow 2B. FIG. 2C is another side view of the stop flange 60 of FIG. 2B along arrow 2C.

Referring to FIGS. 1A-2D, the novel H track bracket can include a rear base member 10 and a front wall member 20 with an elongated cross member therebetween that attaches the rear base member 10 to the front wall member 20. An upper C-shape channel 15 is formed above the elongated cross member 30 in the track bracket 1. A lower C-Shape channel 25 is formed below the elongated cross member 30 in the track bracket 1. Extending outward from the rear base member 10 are opposite protruding tabs 40 and 50 each with respective single through-hole fastening holes 45, 55 therethrough The protruding tabs 40, 50 can each be flat plates that extend outward away from opposite ends of the front wall member 20.

A left L shaped flange 60 can be used to block off left side open ends of both of the upper C-shaped channel 15 and the lower C-shaped channel 25. The left L-shaped channel can have base 62, a through-hole 65 through the base, and a bent stop edge 68. A right L-shaped channel 70 can be used to block off right side open ends of both of the upper C-shaped channel 15 and a the lower C-shaped channel 25. The right L-shaped channel can have base 72, a through-hole 75 through the base, and a bent stop edge 78.

Figure 3:
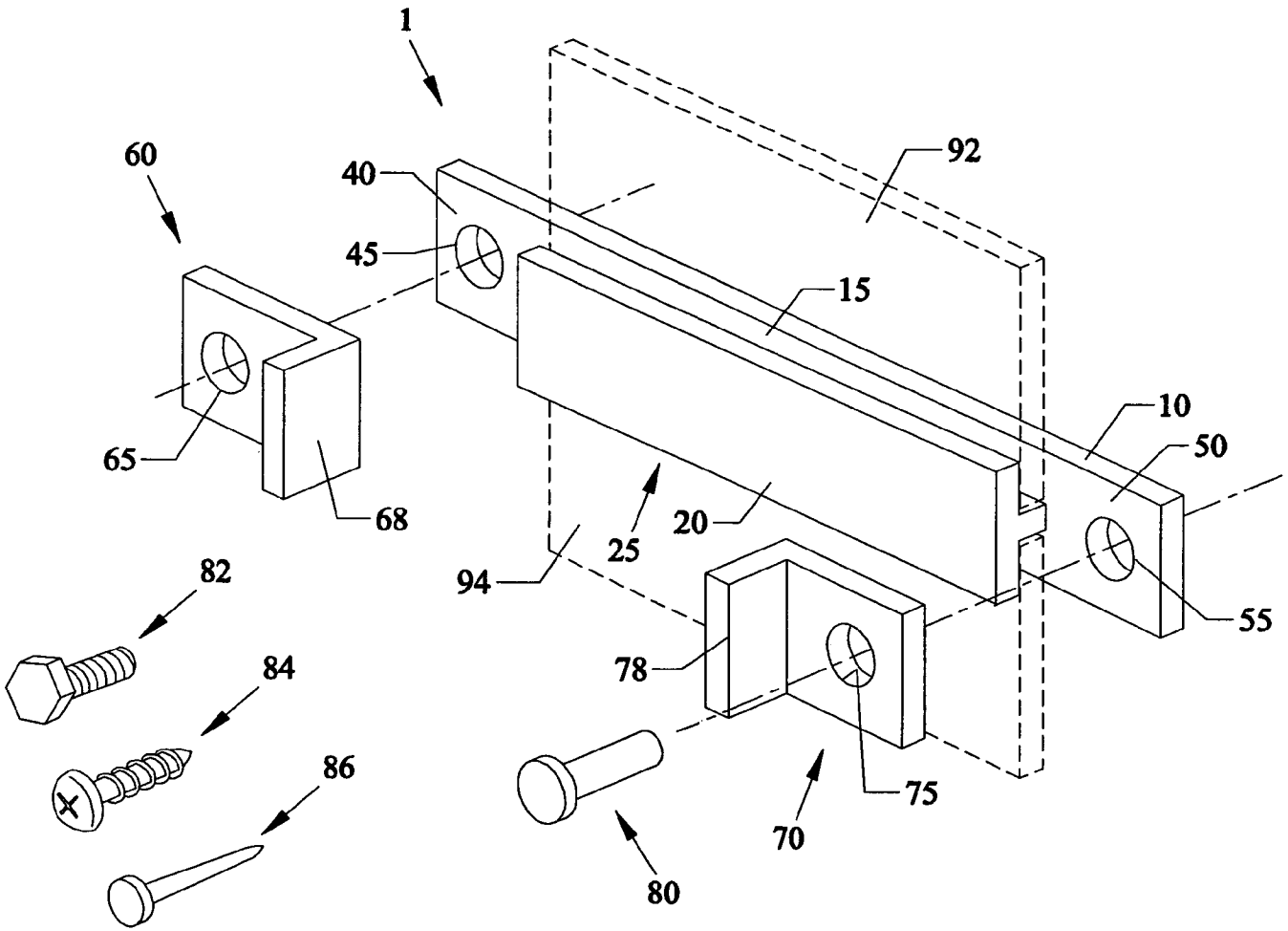
FIG. 3 is an exploded view of a single elongated track bracket with stop flanges of the previous figures being used with storm panels.

FIG. 3 is an exploded view of a single elongated track bracket 1 with stop flanges 60, 70 of the previous figures being used with storm panels 92, 94. A top storm panel 92, such as a plywood panel can have an edge slidably inserted into the upper C shaped channel 15 of the track bracket 1, and a lower storm channel 94 can have an edge slidably inserted into the lower C-shaped channel 25 of the track bracket 1. The C shaped channels 15, 25 can be sized so that the panels 92, 94 can be snugly and tightly held in place. The stop flanges 60, 60 can be positioned so that their respective bent edges 68, 78 close off open side ends of both the upper channel 15 and lower channel 25. Fastener(s) 80, can be inserted through respective through-holes 75, 55, and 65, 45 to hold respective stop flanges 60, 60 to the track bracket 1.

Figure 4:
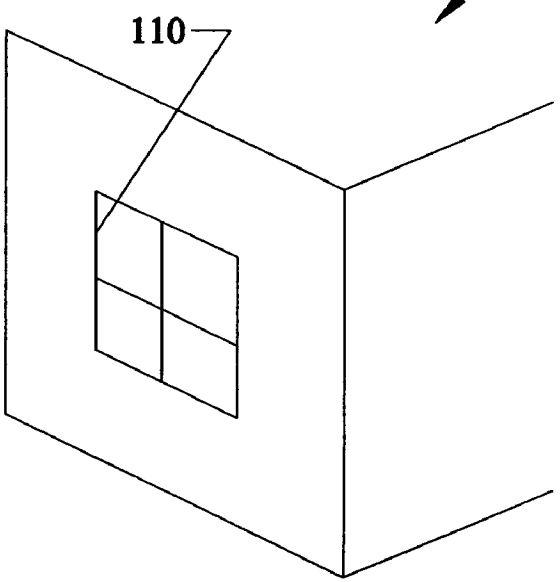
FIG. 4 is a perspective view of a building with window opening.
Figure 5:
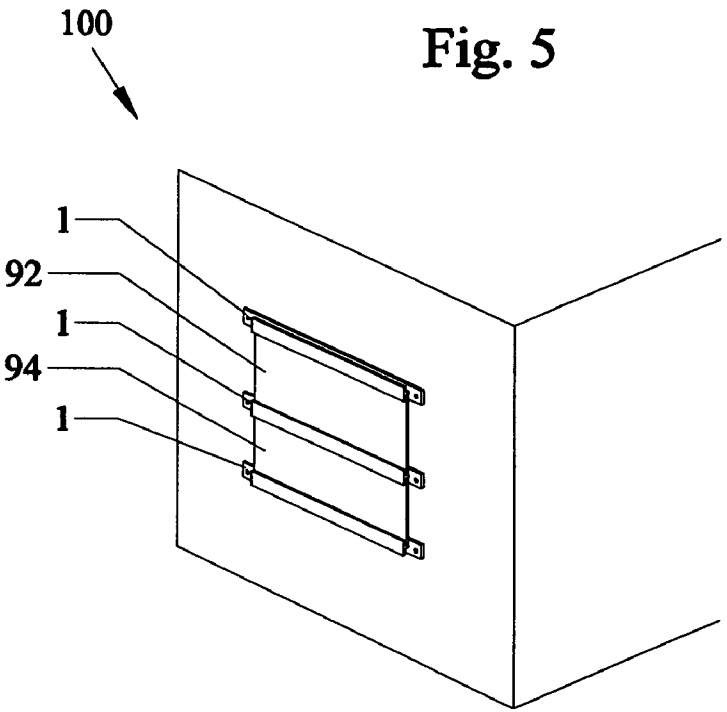
FIG. 5 shows the building with window opening of FIG. 4 with three track brackets and storm panels held in place.

FIG. 4 is a perspective view of a building 100 with window opening 110. FIG. 5 shows the building 100 with window opening 110 of FIG. 4 with three track brackets 1 and storm panels 92, 94 held in place in horizontal orientations over the opening. As shown in FIG. 5, the tab ends 40, 50 of each track bracket can beyond the actual window opening to attach and mount the panels into the frames about the windows. Alternatively, for added strength, the brackets 1 can be sized so that the tabs 40, 50 can be mounted into the wall structure outside of the window frames.

Figure 6:
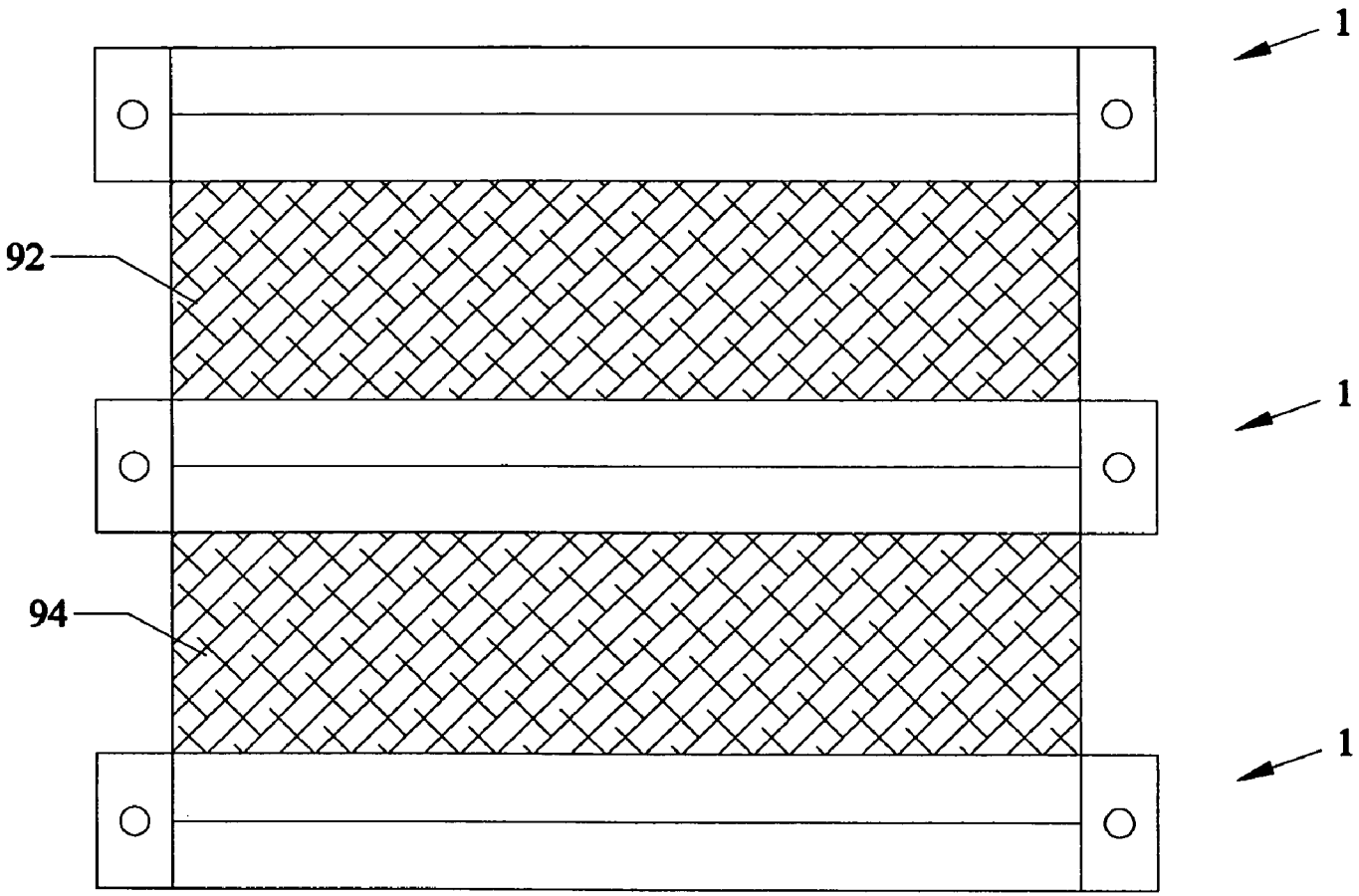
FIG. 6 shows another view of mounting the novel track brackets to be vertically spaced apart parallel to one another.

FIG. 6 shows another view of mounting the navel track brackets 1 to be vertically spaced apart parallel to one another over a window opening 110. The brackets and the stop flanges would allow for supporting the storm panels in place.

The novel invention can be easily disassembled at least as quickly as it is assembled on site.

The novel invention can be used for smaller sized building openings by only having a single rectangular storm panel held in place by two elongated track brackets where only four fasteners are used. Unlike the prior art which would require fasteners between every approximately 4 to approximately 10 inches apart around the perimeter.

Also, building openings can use three or more of the track brackets and use existing small or different sized plywood type panels that are already readily available. For example, a large sliding glass door 80 inches high by up to 80 inches wide, can be effectively protected with the invention by using a standard 8×4 foot piece of plywood. Here, a standard 8×4 foot piece of plywood which is normally not easy to hold and support by one person can be cut in half. Thereby each piece 8×2 foot piece that is thin and easy to manage, can be positioned in place with three track brackets to effectively cover the 80 inch glass door opening. Also the installer can use different custom sized panels between the channels of the track brackets.

Unlike the procedure of nailing up plywood which only allows for a single season use, the invention allows the plywood to be reusable since no nails or other fasteners are driven directly into the plywood perimeter edges. It is reusable since the plywood can be stackable since the edges have not been ripped up by the nail holes or fastener holes.

Also, the invention can, be used with similar benefits with Plexiglas and plastic. Additionally, the channel openings can be adjusted for different sized panels such as approximately ½ inch minimum up to approximately ¾ inch. Additionally, the channels can support much thicker storm panels such as the corrugated metal and/or plastic storm panels in the marketplace.

While the preferred embodiment has the elongated mounting tracks standing vertical upright and parallel to one another, the novel elongated mounting tracks can be used in horizontal orientations above and below the building openings, as well as additionally between the above and below horizontally oriented tracks.

Although a preferred embodiment is shown mounting the novel elongated mounting tracks over window openings the novel invention can be used with protecting door openings with the track brackets 1 also mounted in horizontal parallel orientations.

In addition, the novel track brackets can be mounted vertically for door applications. For example, door openings having a raised bottom edge on the door will allow for the lower tabs of the elongated mounting tracks to be mounted below the left and right corners of the door itself. In addition, the lower tabs can be bent outward so that fasteners can attach to floor edges below the left and bottom right corner edges of the door opening.

Sides of the elongated mounting tracks can have additional through-holes for additional, fasteners to add strength to holding and mounting the panels over the door and window openings.

The fasteners used with the invention can be bolts. The fasteners can also be screws. The fasteners can also be nails. Additionally, other fasteners can be used that are strong enough to withstand being pulled from mounting structure by hurricane level winds, and the like. Also, the fasteners can be left permanently in the wall edges about the building openings. The fasteners can alternatively be capped with aesthetic covers, and/or painted, and/or left anchored in place.

Spacer washers such as resilient rings, rubber washers, rubber grommets, and the like, can be used between the tab plates and the window/door casing frames to further space the shutter panels from directly contacting the window glass and doors. Additionally resilient material spacers, and the like can be used to line the channels has needed if a tighter fit is needed from the shutter panel edges are fit into the C channels on the H tracks. The spacer material can also be used to separate the shutter panels from directly contacting the window glass and doors themselves.

Figure 7:
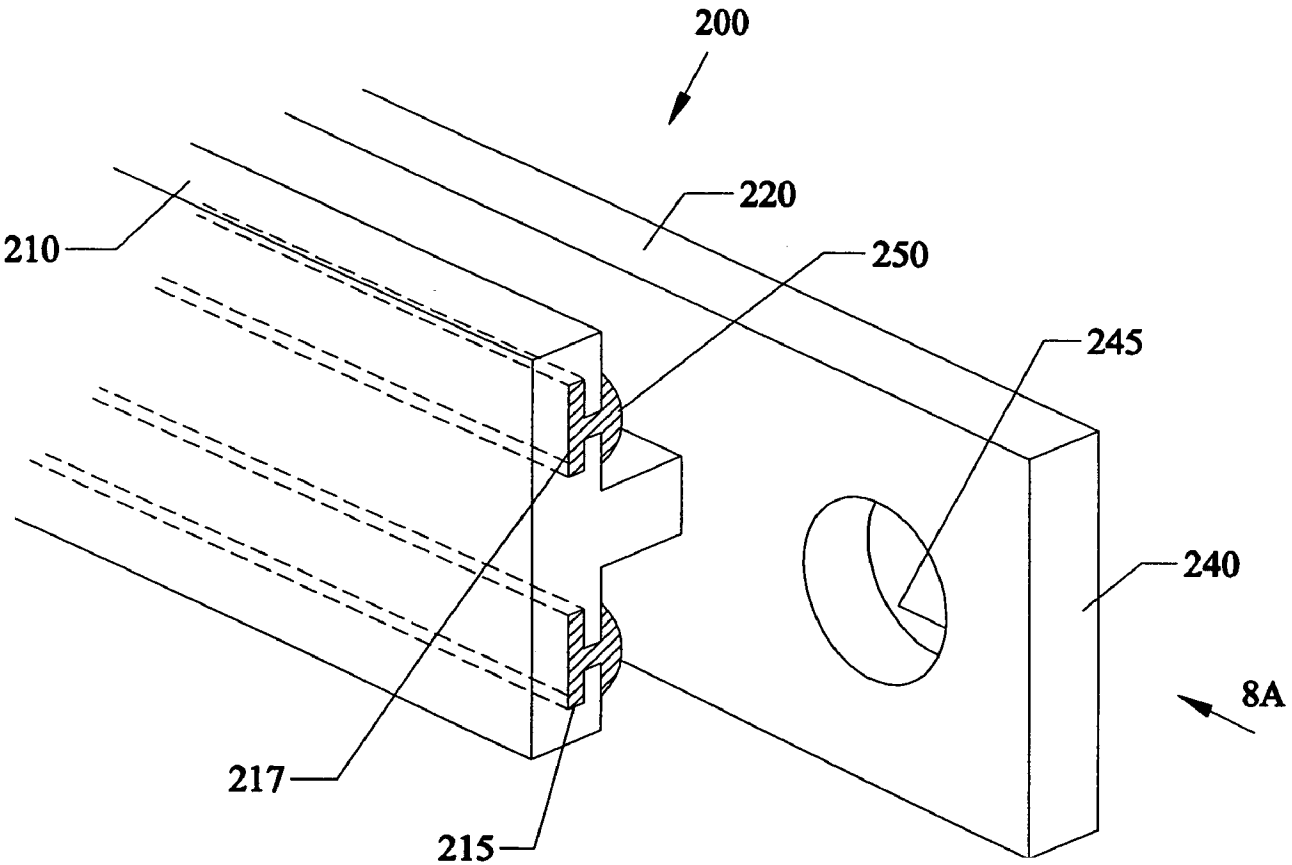
FIG. 7 shows a perspective portion of another embodiment using rubber gasket spacers.
Figure 8A:
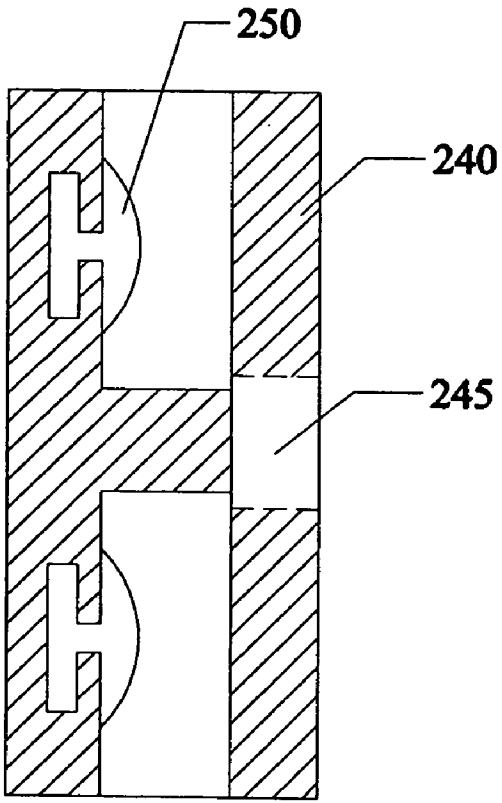
FIG. 8A shows an end view of the embodiment of FIG. 7 with gasket spacers.
Figure 8B:
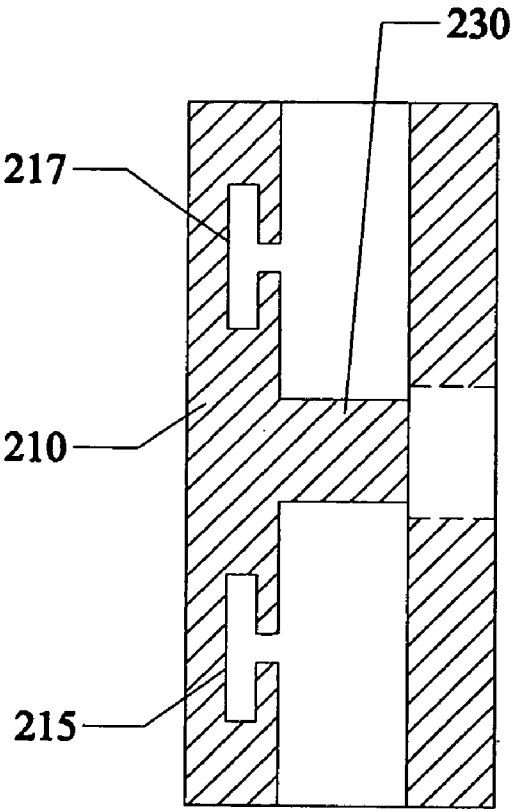
FIG. 8B shows another end view of the embodiment of FIG. 7 without gasket spacers.

FIG. 7 shows a perspective portion of another embodiment 200 using rubber gasket spacers 250. FIG. 8A shows an end view of the embodiment 200 of FIG. 7 with gasket spacers 250. FIG. 8B shows another end view of the embodiment 200 of FIG. 7 without gasket spacers. Referring to FIGS. 7-8B, the track bracket 200 can have a pair of elongated T shaped grooves 215, 217 so that mateable resilient headed gaskets can slide and be held in place in the channel openings separated by mid cross member separator 230. The tab 240 and through-hole 245 are identical to those in the previous embodiments.

Rectangular storm panels can be installed and work by only having to use the fastening holes in the tab ends of the mounting tracks. No additional fasteners are generally required and used to mount the panels over the building openings.

When needed to protect all four side edges of storm panels, the invention can use two-three H brackets in combination with brackets adapted to cover the exposed unbrackcted side edges. For example, additionally H track brackets can be used to frame off all four side edges of the shutters. Also, C channel brackets can be used in combination with the H track brackets. Also, small "h" shaped brackets can be used in combination with the H shaped track brackets.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A storm panel mounting system for mounting storm panels over window and door openings, comprising:

an exterior opening to a building the exterior rectangular opening having frame edges, the exterior rectangular opening being selected from at least one of a door opening with a door covering the door opening, and a window opening with a window covering the window opening;

a rectangular shutter panel being sized to substantially cover a portion of the exterior rectangular opening, the rectangular shutter panel having an elongated left side edge and an elongated right side edge;

a first elongated mounting track having an H cross-sectional shape between opposing left and right ends, the first elongated mounting track having a upper facing U shaped channel along one elongated side and an opposite lower facing U shaped channel along an another elongated side that is directly opposite to the one elongated side, each of the opposing left and right ends of the first elongated mounting track having outwardly protruding tabs, with each of the tabs having a through-hole;

a first left fastener for fastening the left tab of the first elongated mounting track into a portion of the frame edge above a left corner of the rectangular building opening;

a first right fastener for fastening the right tab of the first elongated mounting track into a portion of the frame edge above a right corner of the rectangular building opening;

a second elongated mounting track having an H cross-sectional shape between opposing left and right ends, the second elongated mounting track having a upper facing U shaped channel along one elongated side and an opposite lower facing U shaped channel along an another elongated side that is directly opposite to the one elongated side, each of the opposing left and right ends of the second elongated mounting track having outwardly protruding left and right tabs, with the left tab and the right tab having a through-hole;

a second left fastener for fastening the left tab of the second elongated mounting track into a portion of the frame edge below the left corner of the rectangular building opening;

a second right fastener for fastening the right tab of the second elongated mounting track into a portion of the frame edge below the right corner of the rectangular building opening, so that the rectangular shutter panel is held in place over the portion of the exterior building opening by the first elongated mounting track and the second elongated mounting track, wherein the elongated top side edge of the rectangular shutter panel fits into the lower facing U shaped channel of the first elongated mounting track, and the elongated bottom side edge of the rectangular shutter panel fits into the upper facing U shaped channel of the second elongated mounting track; and two L shaped flanges for being attached to the tabs by the left and right fasteners for preventing the shutter panel from sliding sideways out from the upper and lower facing U shaped channels.

2. The storm panel mounting system of claim 1, wherein the first fasteners and the second fasteners are screws.

3. The storm panel mounting system of claim 1, wherein the first fasteners and the second fasteners are bolts.

4. The storm panel mounting system of claim 1, wherein the first fasteners and the second fasteners are nails.

5. The storm panel mounting system of claim 1 wherein the first rectangular shutter panel is plywood.

6. The storm panel mounting system of claim 1 wherein the first rectangular shutter panel is metal.

7. The storm panel mounting system of claim 1 wherein the first rectangular shutter panel is a plastic panel.

8. The mounting track for attaching storm panels of claim 1, wherein the top tab and the bottom tab are each single flat plates, each with only a single through-hole through each plate.

9. A mounting track for attaching storm panels over window and door openings, the mounting track comprising:

an elongated member having an H cross-sectional shape between opposing top and bottom ends;

a left facing U shaped channel along one elongated side the elongated member;

a right facing U shaped channel opposite the left facing U shaped channel, the right facing U shaped channel along an another elongated side that is directly opposite to the one elongated side; and outwardly protruding tabs extending from each of the opposing top and bottom ends of the elongated member and each of the top tab and the bottom tabs having a through-hole for receiving a respective fastener therethrough; and blocking members for being attached to the tabs by the respective fasteners for preventing a shutter panel from sliding sideways out from the channels, wherein the blocking members include L shaped flanges.

10. A method of mounting shutter panels to window and door openings, comprising the steps of:

providing a rectangular shutter panel being sized to substantially cover a portion of the exterior rectangular opening, the rectangular shutter panel having an elongated upper side edge and an elongated lower side edge;

providing a first elongated mounting track having an H cross-sectional shape between opposing left and right ends, the first elongated mounting track having a upper facing U shaped channel along one elongated side and an opposite lower facing U shaped channel along an another elongated side that is directly opposite to the one elongated side, each of the opposing left and right ends of the first elongated mounting track having outwardly protruding tabs, with the left tab and the right tab having a through-hole;

fastening a first left fastener to the left tab of the first elongated mounting track into a portion of the frame edge above a left corner of the rectangular building opening;

fastening a first right fastener to the right tab of the first elongated mounting track into a portion of the frame edge above a right corner of the rectangular building opening;

providing a second elongated mounting track having an H cross-sectional shape between left and right ends, the second elongated mounting track having a upper facing U shaped channel along one elongated side and an opposite lower facing U shaped channel along an another elongated side that is directly opposite to the one elongated side, each of the opposing left and right ends of the second elongated mounting track having outwardly protruding tabs, with the left and right tabs each having a through-hole;

fastening a second left fastener to the left tab of the second elongated mounting track into a portion of the frame edge below the left corner of the rectangular building opening;

fastening a second right fastener to the right tab of the second elongated mounting track into a portion of the frame edge below the right corner of the rectangular building opening, mounting the rectangular shutter panel over the portion of the exterior building opening by the first elongated mounting track and the second elongated mounting track;

providing L shaped flanges as blocking members; and preventing the shutter panel from sliding sideways out from the channels with the blocking members attached by the fasteners.

11. The method of claim 10, wherein the step of mounting the rectangular shutter panel includes the steps of:

slidably inserting the elongated upper side edge of the rectangular shutter panel to fit into the lower facing U shaped channel of the first elongated mounting track; and slidably inserting the elongated lower side edge of the rectangular shutter panel to fit into the upper facing U shaped channel of the second elongated mounting track.

12. A storm panel mounting system for mounting storm panels over window and door openings, comprising:

an exterior opening to a building the exterior rectangular opening having frame edges, the exterior rectangular opening being selected from at least one of a door opening with a door covering the door opening, and a window opening with a window covering the window opening;

a rectangular shutter panel being sized to substantially cover a portion of the exterior rectangular opening, the rectangular shutter panel having an elongated left side edge and an elongated right side edge;

a first elongated mounting track having an H cross-sectional shape between opposing left and right ends, the first elongated mounting track having a upper facing U shaped channel along one elongated side and an opposite lower facing U shaped channel along an another elongated side that is directly opposite to the one elongated side, each of the opposing left and right ends of the first elongated mounting track having outwardly protruding tabs, with each of the tabs having a through-hole;

a first left fastener for fastening the left tab of the first elongated mounting track into a portion of the frame edge above a left corner of the rectangular building opening;

a first right fastener for fastening the right tab of the first elongated mounting track into a portion of the frame edge above a right corner of the rectangular building opening;

a second elongated mounting track having an H cross-sectional shape between opposing left and right ends, the second elongated mounting track having a upper facing U shaped channel along one elongated side and an opposite lower facing U shaped channel along an another elongated side that is directly opposite to the one elongated side, each of the opposing left and right ends of the second elongated mounting track having outwardly protruding left and right tabs, with the left tab and the right tab having a through-hole;

a second left fastener for fastening the left tab of the second elongated mounting track into a portion of the frame edge below the left corner of the rectangular building opening;

a second right fastener for fastening the right tab of the second elongated mounting track into a portion of the frame edge below the right corner of the rectangular building opening, so that the rectangular shutter panel is held in place over the portion of the exterior building opening by the first elongated mounting track and the second elongated mounting track, wherein the elongated top side edge of the rectangular shutter panel fits into the lower facing U shaped channel of the first elongated mounting track, and the elongated bottom side edge of the rectangular shutter panel fits into the upper facing U shaped channel of the second elongated mounting track; and first resilient spacers in the U shaped channels of the first elongated mounting track for preventing the shutter panel from sliding out of the first elongated mounting track; and second resilient spacers in the U shaped channels of the second elongated mounting track for preventing the shutter panel from sliding out of the first elongated mounting track, wherein the first and second resilient spacers include gasket spacers mounted in T shaped grooves of the mounting tracks.

13. A mounting track for attaching storm panels over window and door openings, the mounting track comprising:

an elongated member having an H cross-sectional shape between opposing top and bottom ends;

a left facing U shaped channel along one elongated side the elongated member;

a right facing U shaped channel opposite the left facing U shaped channel, the right facing U shaped channel along an another elongated side that is directly opposite to the one elongated side;

outwardly protruding tabs extending from each of the opposing top and bottom ends of the elongated member and each of the top tab and the bottom tabs each having a through-hole for receiving a respective fastener therethrough; and resilient spacers in the U shaped channels of the elongated mounting track for preventing the shutter panel from sliding out of the first elongated mounting track, wherein the resilient spacers include gasket spacers being mounted in T shaped grooves on the mounting tracks.

14. A method of mounting shutter panels to window and door openings, comprising the steps of providing a rectangular shutter panel being sized to substantially cover a portion of the exterior rectangular opening, the rectangular shutter panel having an elongated upper side edge and an elongated lower side edge;

providing a first elongated mounting track having an H cross-sectional shape between opposing left and right ends, the first elongated mounting track having a upper facing U shaped channel along one elongated side and an opposite lower facing U shaped channel along an another elongated side that is directly opposite to the one elongated side, each of the opposing left and right ends of the first elongated mounting track having outwardly protruding tabs, with the left tab and the right tab having a through-hole;

fastening a first left fastener to the left tab of the first elongated mounting track into a portion of the frame edge above a left corner of the rectangular building opening;

fastening a first right fastener to the right tab of the first elongated mounting track into a portion of the frame edge above a right corner of the rectangular building opening;

providing a second elongated mounting track having an H cross-sectional shape between left and right ends, the second elongated mounting track having a upper facing U shaped channel along one elongated side and an opposite lower facing U shaped channel along an another elongated side that is directly opposite to the one elongated side, each of the opposing left and right ends of the second elongated mounting track having outwardly protruding tabs, with the left and right tabs each having a through-hole;

fastening a second left fastener to the left tab of the second elongated mounting track into a portion of the frame edge below the left corner of the rectangular building opening;

fastening a second right fastener to the right tab of the second elongated mounting track into a portion of the frame edge below the right corner of the rectangular building opening, mounting the rectangular shutter panel over the portion of the exterior building opening by the first elongated mounting track and the second elongated mounting track; and preventing the shutter panel from sliding sideways out from the U shaped channels with resilient spacers in the first and the second elongated mounting tracks, wherein the resilient spacers include gasket spacers being mounted in T shaped grooves of the mounting tracks.

* * * * *